US005782047A

United States Patent [19]

De Quesada

[11] Patent Number: 5,782,047

[45] Date of Patent: Jul. 21, 1998

[54] HIGH-RISE BUILDING SYSTEM USING LIGHT GAUGE STEEL WALL PANELS

[76] Inventor: Jorge De Quesada, 477 Pacific Ave., San Francisco, Calif. 94133

[21] Appl. No.: 684,461

[22] Filed: Jul. 19, 1996

[51] Int. Cl.[6] ..... E04H 1/00; E04C 2/34

[52] U.S. Cl. ..... 52/236.6; 52/79.1; 52/266; 52/270; 52/283; 52/481.1; 52/483.1; 52/585.1; 52/693; 52/781.3; 52/790.1; 52/801.1

[58] Field of Search ..... 52/79.1, 266, 270, 52/283, 285.2, 481.1, 483.1, 781.3, 585.1, 790.1, 801.1, 653.2, 693, 690, 236.6

[56] References Cited

U.S. PATENT DOCUMENTS

| | | | |
|---|---|---|---|
| 2,076,728 | 4/1937 | Keller | 52/790.1 X |
| 4,235,054 | 11/1980 | Cable et al. | 52/481.1 X |
| 4,514,950 | 5/1985 | Goodson, Jr. | 52/645 X |
| 4,748,781 | 6/1988 | Wencley | 52/801.1 X |
| 5,218,803 | 6/1993 | Wright | 52/481.1 X |
| 5,505,031 | 4/1996 | Heydon | 52/790.1 X |

*Primary Examiner*—Christopher Kent

*Attorney, Agent, or Firm*—Flehr Hohbach Test Albritton & Herbert, LLP

[57] ABSTRACT

A high-rise building system using light gauge steel wall panels provides for a variety of panels of various vertical and lateral force resistance by combining cold rolled and hot rolled steel sections in various configurations. The planar design makes possible easy wall cladding, installation of floors and ceilings and faster and less expensive construction.

15 Claims, 12 Drawing Sheets

HIGH-RISE BUILDING SYSTEM USING LIGHT GAUGE STEEL WALL PANELS

The present invention is directed to a high-rise building system using light gauge steel wall panels and more particularly where the wall panels are able to resist both vertical and lateral forces.

BACKGROUND OF THE INVENTION

As illustrated in U.S. Pat. No. 4,235,054, prefabricated walls where the studs are cold rolled steel of, for example, 20 gauge thickness have many advantages over wood or masonry construction. These include repeatability of quality, accuracy, incombustibility, speed of construction and lightweight. For example, as disclosed in the above patent a wall section constructed of steel studs would weight about 97 pounds and a similar wall section of wood members 134 pounds. Then, the patent talks about even lower weights with thinner gauge steel which is 20 gauge. A major problem, however, has been the lack of resistance to vertical and lateral forces of these sheet metal stud wall panels for multi-story buildings of, for example, three floors or higher. And then, of course, as pointed out by the above patent there are still many construction problems associated with the use of steel studs versus wood.

OBJECTS AND SUMMARY OF INVENTION

It is a general object of the present invention to provide an improved prefabricated light gauge steel wall panel and associated related improved construction techniques in a high-rise building environment.

In accordance with the above object, there is provided a lightweight, prefabricated wall panel which is both resistant to vertical and lateral forces for use as a wall in a multi-story building of three or more stories comprising a plurality of spaced vertical cold rolled light gauge sheet metal studs extending between top and bottom channels in which they are retained, a pair of diagonal tension bracing plates connected to the studs and channels, and a pair of hot rolled steel members affixed vertically to the left and right ends of the panel including the top and bottom channels and the diagonal bracing plates.

The above wall panel may be used in many different modes for easy inter-relationship with floor and roof panels and also with hot rolled steel-type construction for higher buildings; and also for box-shaped unitized room construction such as for kitchens and bathrooms and in general to provide for flexibility in high-rise construction using light gauge steel components.

DETAILED DESCRIPTION OF PREFERRED EMBODIMENTS

Figure 12:
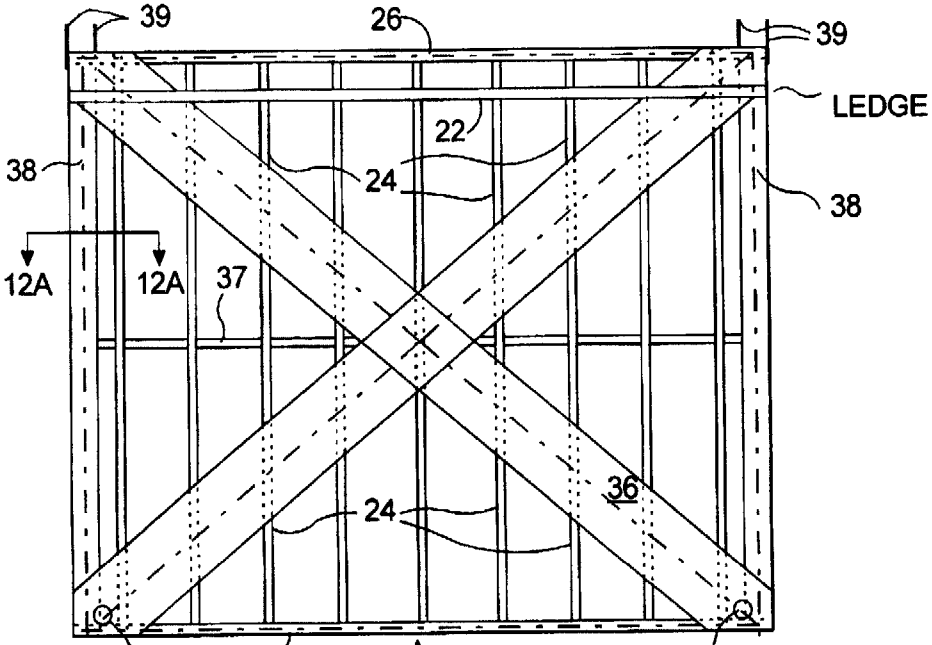
FIG. 12 shows an elevation view of a wall panel embodying the present invention.

FIGS. 1–4 show different building configurations in which the wall panel illustrated in detail in FIG. 12 may be advantageously used. This is a panel 7 resistant to both vertical and lateral forces which consists mainly of a plurality of spaced vertical cold rolled light gauge steel studs 24. The studs may be from 18 through 12 gauge and with a C-type cross-section. Studs 24 are held in place, from an initial construction fabrication standpoint, by an upper channel shaped track 26 and a lower channel shaped track 25. Diagonal bracing plates 36 extend between the left and right end studs 24 and also the upper and lower channel tracks 26 and 25. To provide for greater vertical and lateral force resistance, a pair of hot rolled steel tubular members 38 (see FIG. 12A for a cross-section) are, for example, typically screwed (see FIG. 13B) to the diagonal cross-bracing 36 and the lower and upper channel tracks 25 and 26. The foregoing provides for resistance to high or concentrated overturning loads; for example, caused by seismic and wind events. Thus, as used here, vertical forces include weight load bearing and lateral forces including wind, shear and seismic forces.

Figure 12A:
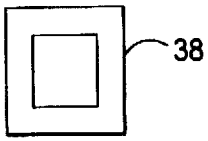
FIG. 12A is a cross-sectional view taken along the line 12A—12A of FIG. 12.

The cross-section illustrated in FIG. 12A of the steel tubes 38 from a width standpoint is the same as studs 24 to provide a planar surface for installation of cladding as will be described below. Although not shown, the opposite side of panel 7 also includes another pair of diagonal cross-braces. These plates are typically 16 to 14 gauge.

Figures 13A, 13B:
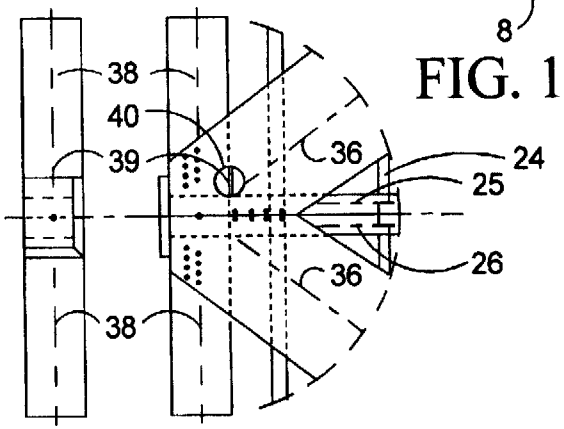
FIGS. 13A and 13B are enlarged detailed views illustrating the connection of two vertically stacked wall panels of FIG. 12.
Figure 32:
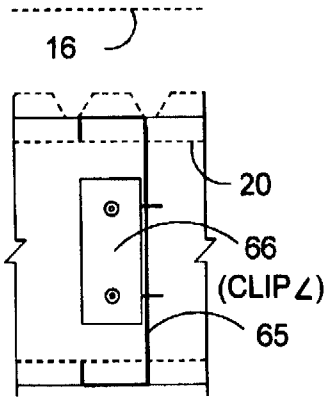
FIG. 32 is a cross-sectional view taken along the line 32—32 of FIG. 30.

If desired, intermediate stud bracing 37 and also a C-shaped may be used which is horizontal as illustrated and held in place by steel clip angles 66 (see FIG. 32). Finally, there is one hot rolled steel angled ledge 22 attached to the studs 24 on at least one of the sides of the wall panel for supporting floor or roof panel assemblies. At the top of each panel assembly and member 38 are a pair of parallel connecting plates 39 whereby one wall panel 7 may be stacked on another to create the keystone of a multi-story building. FIGS. 13A and 13B illustrate such stacking where, of course, the top channel track 26 of the lower panel is against the bottom channel track 25 of the upper panel. The hole 40 facilitates access to the connecting plates 39 of the lower wall assembly for field welding.

Figure 37:
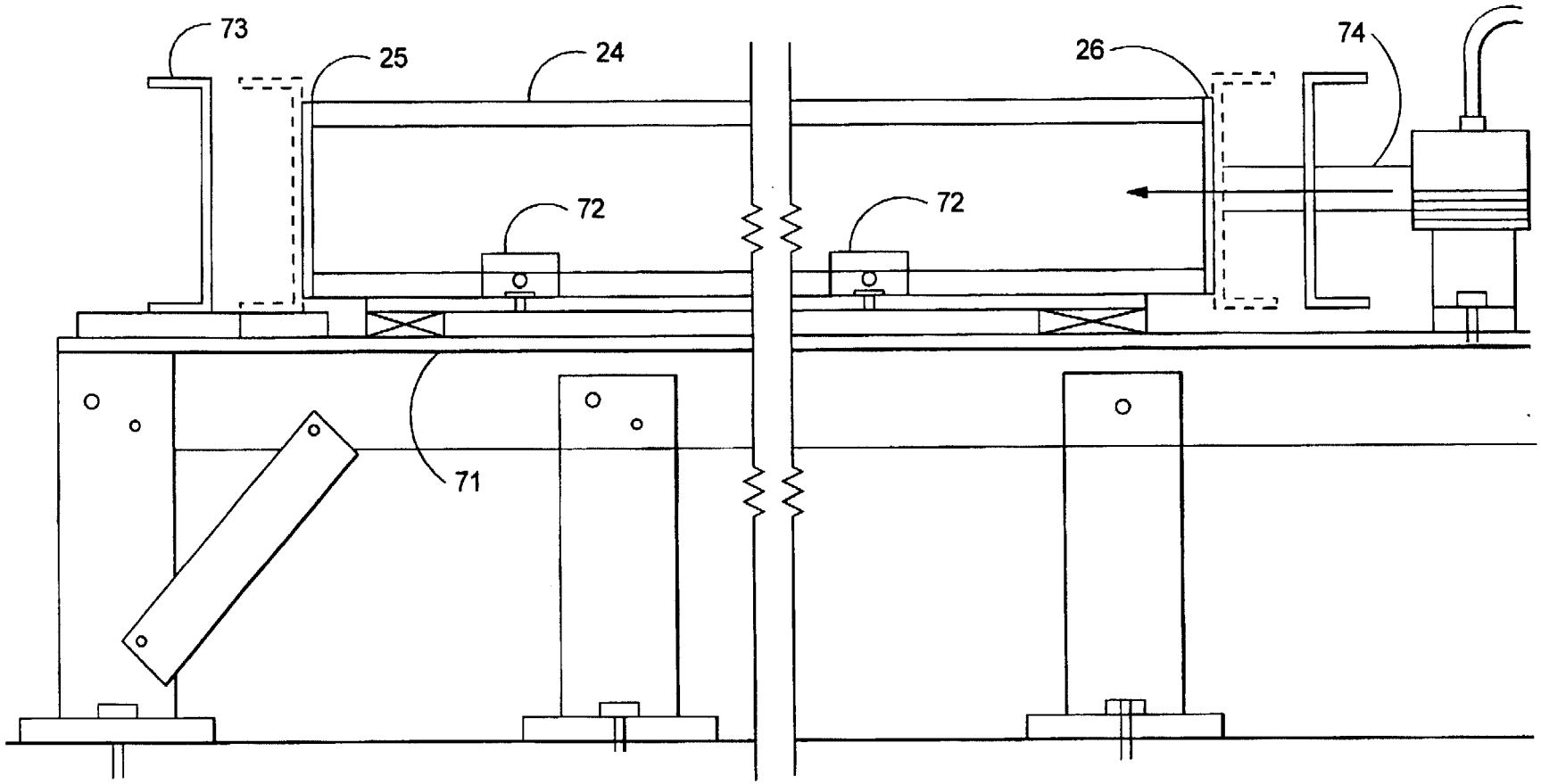
FIG. 37 is a perspective view illustrating a method of the present invention.

Briefly referring to FIG. 37, this illustrates how the panel 7 is constructed. A horizontal table 71 is used where guides 72 provide for alignment of and vertical spacing of the studs 24. Then a restrainer 73 at one end of the table allows for the studs to be placed in the guides and abutted against the restrainer. Next, the bottom channel 25 is placed over the other end of the studs and with a hydraulic clamp 74 channel 25 is pushed onto the ends of the studs. Then reverse of the same may be done for the top channel 26.

Now referring back to FIGS. 1–4, all of these show stacked wall panels 7. In summary, the present invention is intended for buildings up to 160 feet in height in seismic areas and more in other locations. It is suitable for building types containing numerous partitions and repetitive floor plan layouts such as found in multi-family housing, dormitories, hotels and the like. Some of the components could find application in other types of building programs such as office buildings, schools, hospitals, etc.

Figure 1:
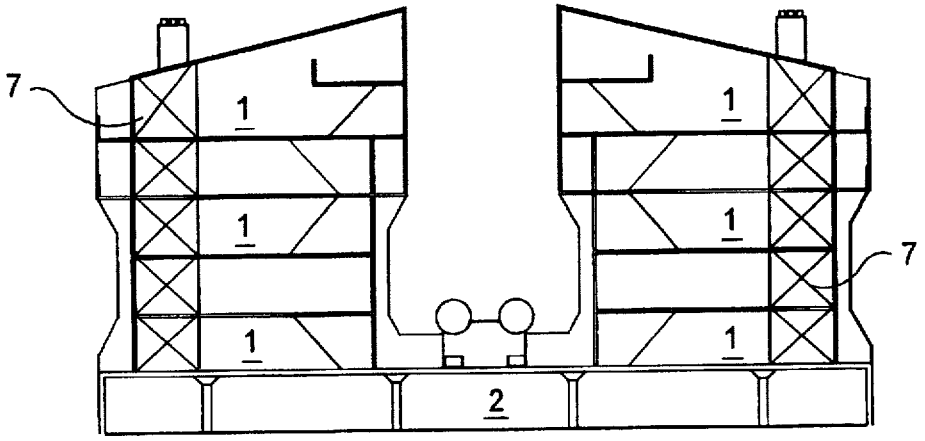
FIG. 1 is a cross-sectional view of a apartment house using the wall panels of the present invention.
Figure 2:
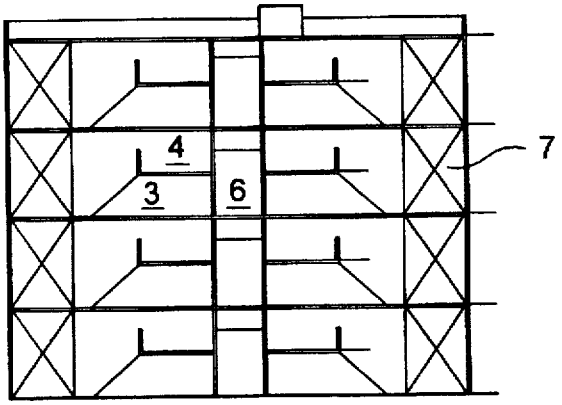
FIG. 2 is a simplified cross-section of four story stacked loft units using the wall panels of the present invention.
Figure 3:
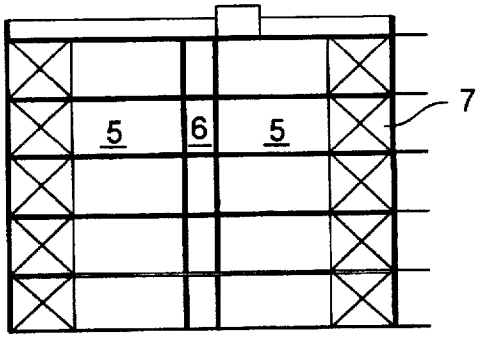
FIG. 3 is a cross-section of a typical five story building using the wall panels of the present invention.

Referring to FIG. 1, this is a dual row of two-level apartment units 1 supported by a parking garage 2 which, for example, might be of reinforced concrete construction. FIG. 2 is a four story building of stacked loft units 3 with mezzanines 4. FIG. 3 describes a typical five story building with flat units 5 arranged at either side of a central corridor 6. In all of these three FIGS. 1, 2 and 3, of course, the stacked lateral/vertical (shear/bearing) force resistant wall panels 7 are diagrammatically shown at each floor.

Figure 4:
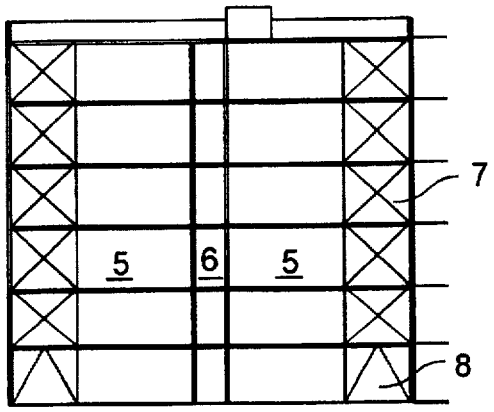
FIG. 4 is a cross-section of a typical six story building using the wall panels of the present invention.

FIG. 4 is a typical six story building which has wall panels 7 on the five upper floors with the flat units 5 placed at either side of a central corridor 6. However, because of either building code restrictions, load bearing limits and/or shear resistance limitations the bottom floor of the building has a different type of shear/bearing wall 8. This is essentially constructed of hot rolled steel and has an inverted "V" support structure.

Figure 14:
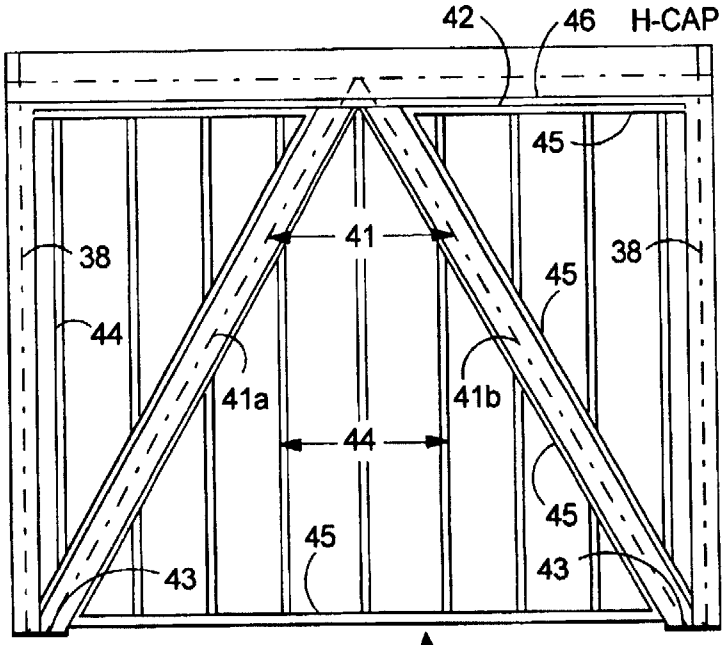
FIG. 14 is an elevation view of an alternative type wall panel using hot rolled tubular steel members.

FIG. 14 shows this alternative wall panel 8 in detail which in addition to the hot rolled tubular steel members 38, which serve as vertical columns, has inverted V-shaped slopped bracing 41*a* and 41*b*. Cold rolled steel connecting plates 43 are attached to the bottom of the end columns 38 as well as the slopping support columns 41*a* and 41*b*. They are generally welded to the end columns 38 to form a continuous vertical truss resisting lateral forces as well as taking its share of tributary vertical loads. Top beam 42 may also be of hot rolled tubular steel and welded to the slopping columns 41*a*, 41*b* and end columns 38. Inverted U-shaped cap 46 is placed over the top beam of the panel 8 as will be described below. Connected to both beams 41 and 42 may be non-load bearing assemblies needed to support the required wall cladding. These assemblies include the upper and lower horizontal tracks 45 and oblique tracks 45 (against slopping columns 41) and in addition the vertical hot rolled beams 38. The widths of all of these members are compatible and again provide planar surfaces suitable to receive cladding.

Now referring back to FIG. 4, the first story would include the shear/bearing panels 8 because of their greater load bearing capability.

Figure 5:
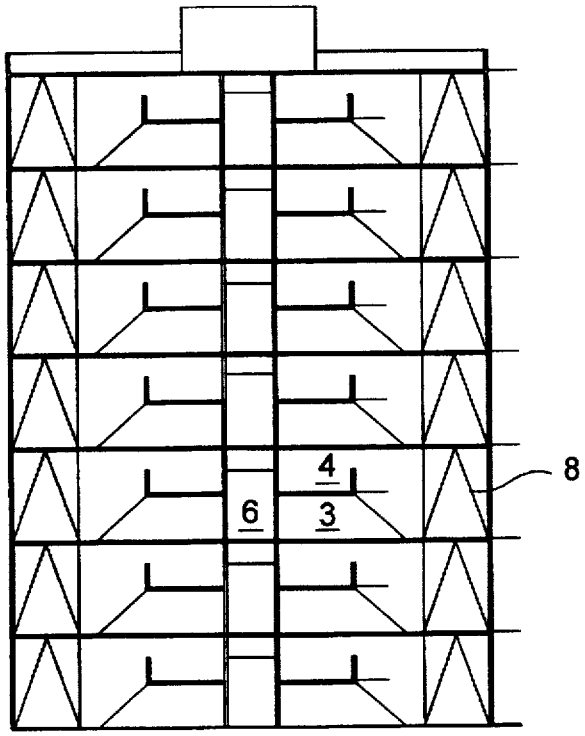
FIG. 5 is a cross-section of a seven story building using an alternative type of wall panel.
Figure 6:
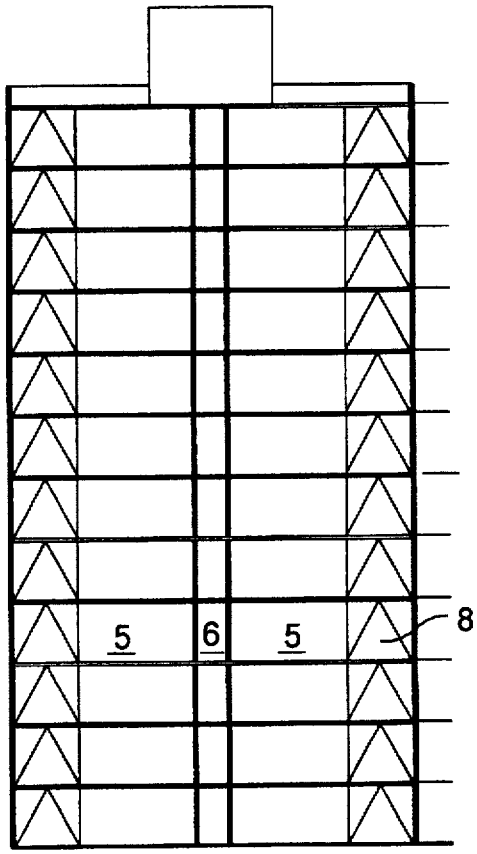
FIG. 6 is a cross-section of a twelve story building using the same type of alternative wall panel.

FIG. 5 shows a seven story building of stacked loft units 3 with mezzanines 4 at either side of a central corridor 6. This building may utilize only the wall panels 8. FIG. 6 is a similar building which is twelve stories but merely with flat units 5 placed at either side of the central corridor 6 using only panels 8.

Thus, FIGS. 1–6 represent only a few of the many arrangements possible by use of the construction system of the present invention. Exterior appearance can be enhanced by means of recesses, bay windows, balconies and other elements built in a similar manner as the wall and floor assemblies. Thus, the relatively lightweight wall panels 7 may be used for the upper floors of the building with the lower floors being heavier panels 8 but with greater load bearing and shear or lateral resistance.

Figure 7:
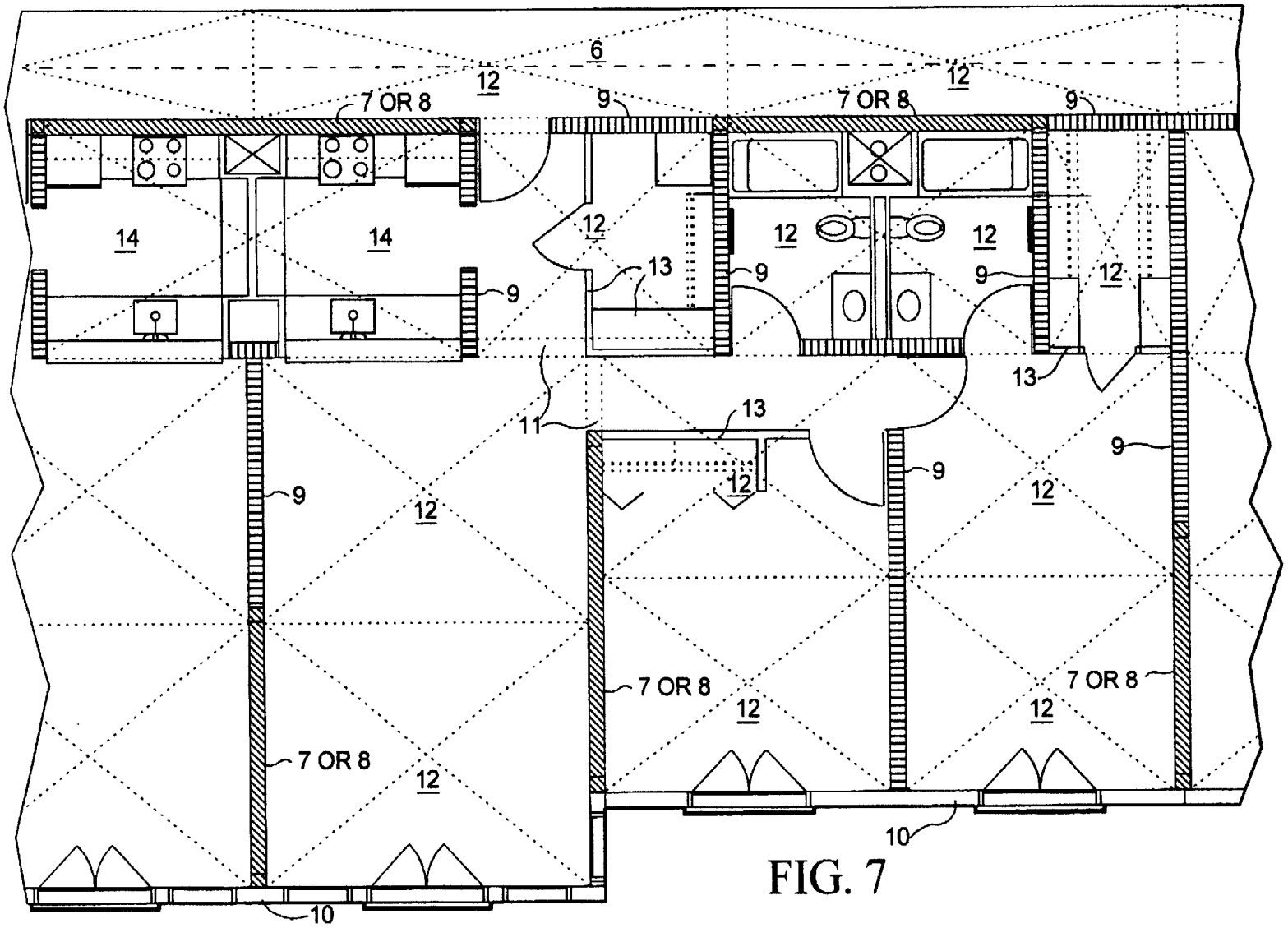
FIG. 7 shows a typical floor layout of a two bedroom flat using wall panels of the present invention and showing a unitized kitchen and bathroom construction.

FIG. 7 illustrates a typical two bedroom flat in a multi-story building with a central corridor 6 and a floor arrangement similar to that shown in FIGS. 3, 4 and 6 but with modular unitized kitchen and bathroom units 14 and 12. As illustrated in heavier cross-section, shear/bearing walls 7 or 8 may be utilized in portions of the apartment, bearing walls 9 only, in lighter cross-section, and exterior non-bearing walls 10. There are also various beams 11, floor panels 12 and interior partitions 13. A roof panel assembly would be built similar to the floor panel assembly 12. Kitchens 14 and bathrooms 12 both have one wall, that is, wall panels 7 or 8, which is load bearing and shear resistant to form a unitized box unit. These box units may either be left unfinished as a structural/enclosure element only or be completed with all the mechanical, electrical, cabinets, fixtures, appliances, accessories and interior finishes. And then they can be delivered to the job site with its interior finished space sealed.

The exterior non-bearing walls 10 are made with frames of light gauge cold rolled steel and cladded as required for fire rating and weather proofing. Any other type of suitable exterior wall system could be used.

Figure 8:
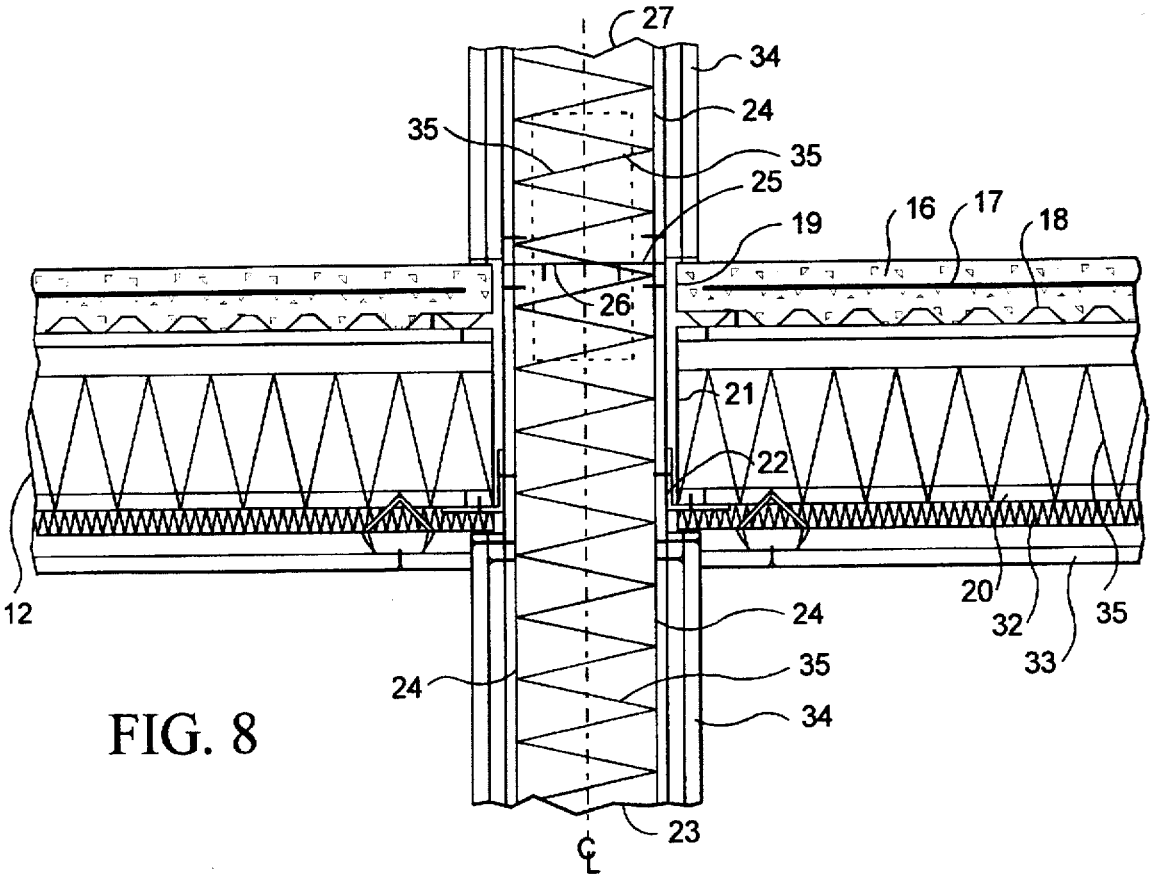
FIG. 8 is a cross-sectional view of a floor assembly used in combination with the wall panels of the present invention.
Figure 9:
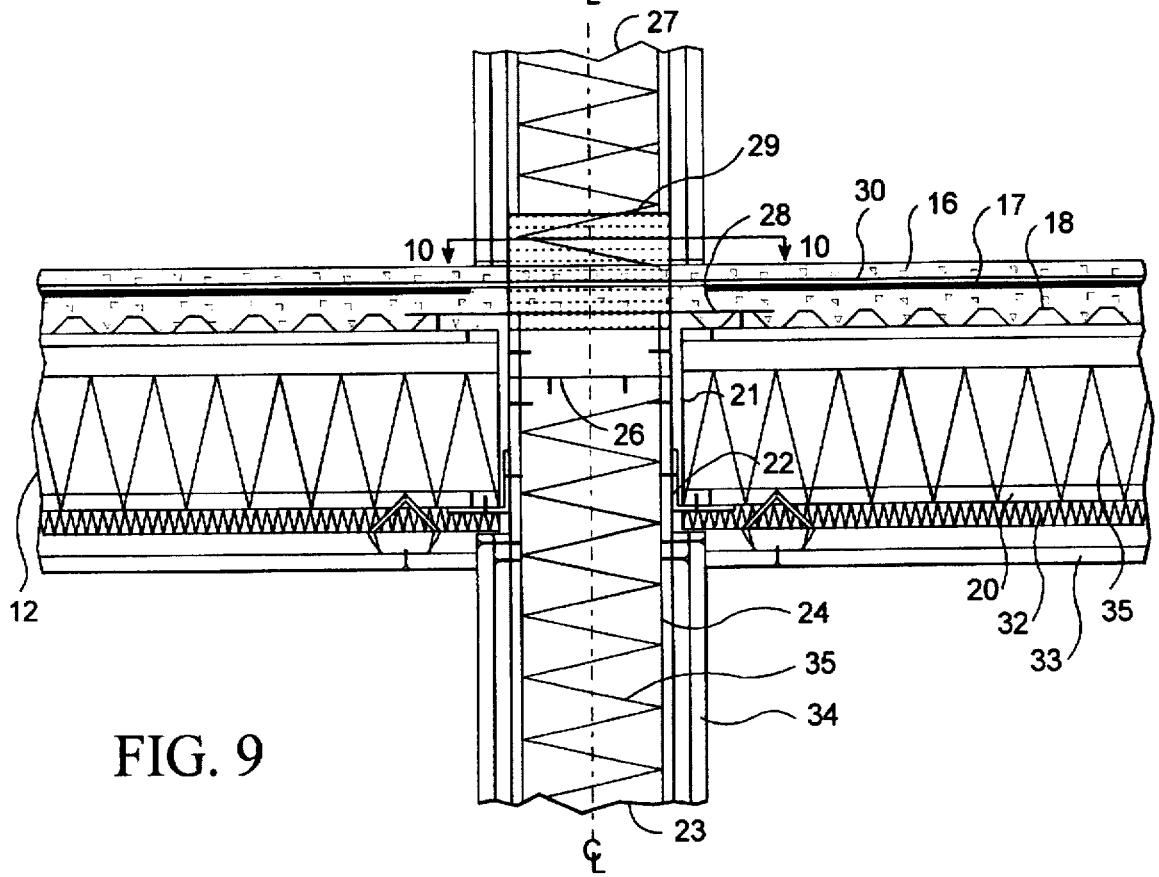
FIG. 9 is a cross-sectional view of an alternative embodiment of FIG. 8.
Figure 11:
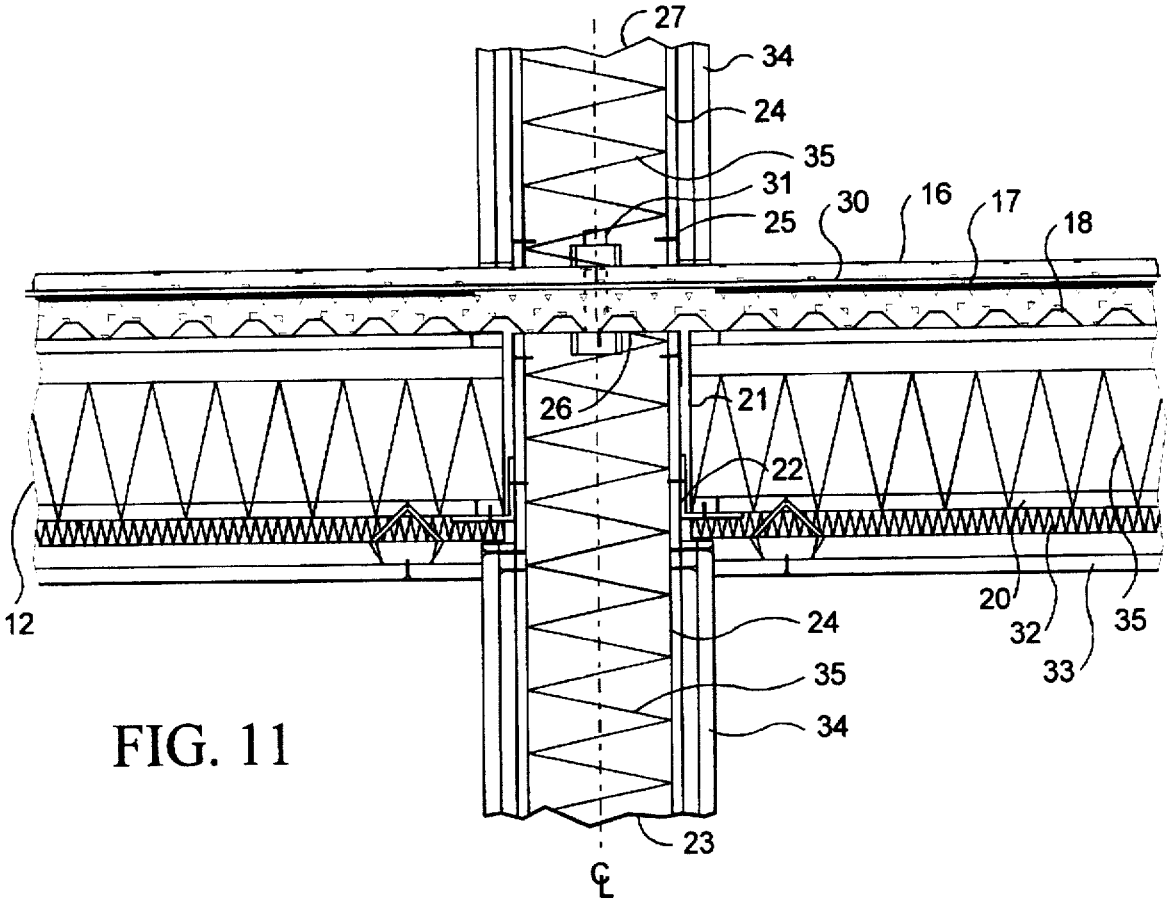
FIG. 11 is a cross-sectional view showing an alternative embodiment of a floor construction technique using the wall panels of the present invention.

FIGS. 8, 9 and 11 show three different types of typical wall/floor joints. In general, FIG. 8 shows the condition where the concrete floor topping 16 is interrupted by a wall assembly totally, FIG. 9 where the concrete may extend between wall studs 24 and FIG. 11 where there is a continuous concrete topping 16 uninterrupted by interior walls.

First referring to FIG. 8, the wall assemblies could either be of all of cold rolled steel type 7 or the inverted "V" hot rolled type 8 or, in fact, bearing only 9. But assuming all of these walls would have the C-type cold rolled studs 24, this is what illustrated in FIGS. 8, 9 and 11.

In general, the concrete topping 16 is reinforced with steel mesh 17 and supported by a light gauge corrugated steel deck 18. Then, steel plate edge deck trim 19 serves as a concrete stopper and screen. The overall floor channels 12 are made of light gauge cold rolled "C"-shaped joists 20. Usually, these are spaced 12, 16 or 24 inches. Channel shaped tracks 21 of the same nominal depth as the joist are included.

The floor assembly 12 rests on the hot rolled steel angled ledges 22 connected to each side of a lower wall assembly indicated as 23. As discussed above, the upper wall assembly, indicated as 27, includes one of the wall panels 7, 8 or 9. Both upper and lower wall panel assemblies show a side view of one of the vertical studs 24.

Each floor panel includes the appropriate fire proofing including a high-density fire resistant blanket 32 and gypsum board suspended ceiling 33. Sound transmission reduction and thermal isolation is achieved by use of batts 35 placed between studs and joists. It is also placed between the studs 24. The main support for the floor assembly 12 is, of course, the steel angled ledge 22 which is also illustrated in FIG. 12. The upper and lower wall assemblies 23 and 27 are connected together by the top and bottom caps 25 and 26 and appropriate screws. Of course, the main connections are the plates 39 (see FIGS. 13A and 13B).

Figure 10:
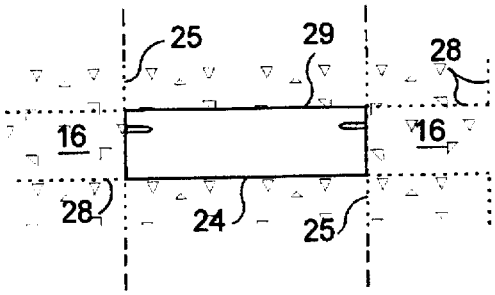
FIG. 10 is a cross-sectional view showing a detail of the floor construction technique taken along line 10—10 of FIG. 9.

FIG. 9 is the variation of FIG. 8 where the joint, that is the joinder of the top and bottom caps 25 and 26, is located below the steel deck 18. Here, the steel decks of opposite floor panels 12 are joined by plates 28 placed between the wall studs 24. The studs themselves are furnished with shoes 29 of the same depth as the studs and about four inches in height. These shoes prevent the flow of concrete to the interior of the C-profile of the studs. See the detailed picture of FIG. 10 where a plate 29 covers the otherwise opened part of the C-shaped stud 24.

Figure 11A:
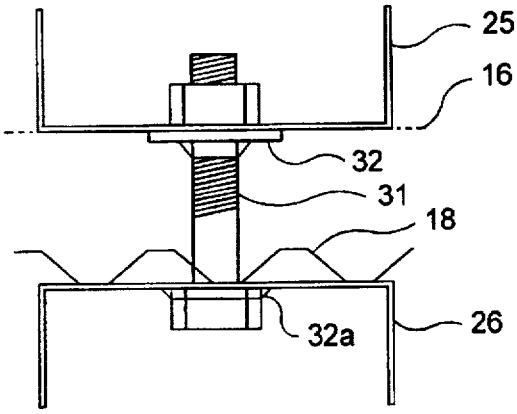
FIG. 11A is a simplified detailed cross-sectional view of a portion of FIG. 11.

Finally, FIG. 11 shows another variation of the wall/floor joint where the concrete topping 16 is placed continuously between the upper 27 and lower wall assembly 23. The lower tracks 25 of the upper wall rests directly against the finished surface of the concrete topping and the upper track 26 of the lower wall assembly 23 rests against the steel deck 18. The special erection bolt 31 (FIG. 11A) provides spacing between the upper and lower wall assemblies and includes a welded washer 32 at the upper end with a welded bolt 32*a* at the lower end at track 26.

Thus, in summary by use of the hot rolled angled edges 22 attached to any of the wall panel variations as illustrated in FIGS. 12 and 14, floor construction is simplified and the cladding 34 may be easily placed on the wall panels and abutted against the concrete floor 16. The wall panels provide continuous finished surfaces by providing even supporting framing surfaces and compatible assemblies of the same depth. Fire proofing by one or more layers of gypsum board cladding 34 may be provided (two are shown).

For the purpose of cladding both with regard to FIGS. 12 and 14, since the steel cold rolled diagonal bracing plates 36 are typically 16 gauge they are thin enough that, for example, gypsum or sheet rock may be easily placed by the use of only minor spacers or resilient Z-shaped channels. And, of course, the gypsum cladding or sheet rock itself may be affixed or screwed onto the sheet metal cross-bracing 36 and studs 24 directly to the hot rolled vertical columns 38. For the panel 8 (FIG. 14), the cold rolled tracks 45 are ideal and in fact installed for that purpose.

Cold rolled tracks 45 may be used for fixing the cladding since these are substantially planar with the vertical hot rolled support ends 38.

Figure 16:
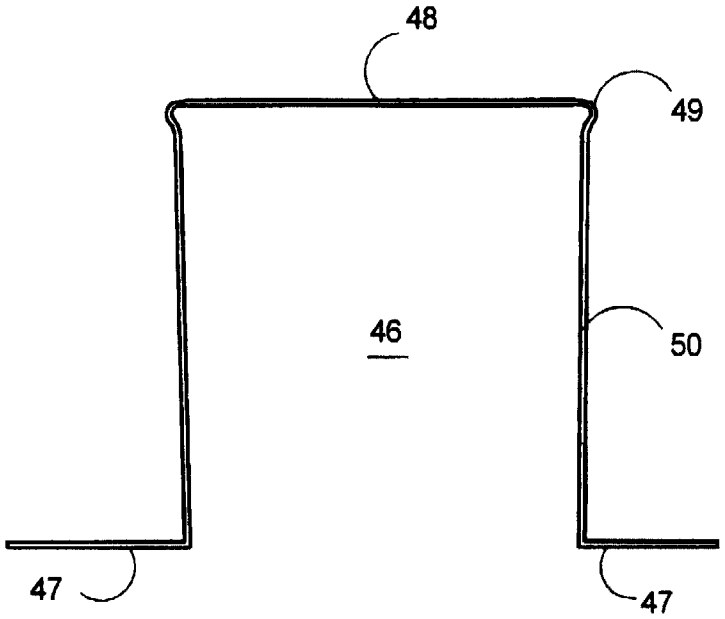
FIG. 16 is an enlarged cross-sectional view of the U-capped portion of FIG. 15.

In relation to the hot rolled V-type shear bearing wall panel 8, rather than a hot rolled steel angled edge 22 for roof or floor supports, a specially profiled inverted "U" upper cap 46 may be used. Now, referring to FIG. 15 and also FIG. 16, this shows a typical wall/floor or roof joint in which the lower wall panel assembly 23 has the special inverted U-shaped cap 46 in lieu of an upper channel-shaped track 26. This specially profiled member 46 shown in detail in FIG. 16 provides the function of the upper track (retaining studs 24) as well as having ledges 47 for supporting floor or roof panel assemblies. Ledges 47 extend horizontally from the ends of side flanges or lags 50. Here, the upper web 48 of the U is widened in order that the bending radius 49 does not interfere with the tight fitting and bearing of the entire end of studs 24 onto the entire width of the web 48. The side flanges 50 of the inverted U-tracks are slopped in order to provide a tight connection with the studs 24.

Figure 18:
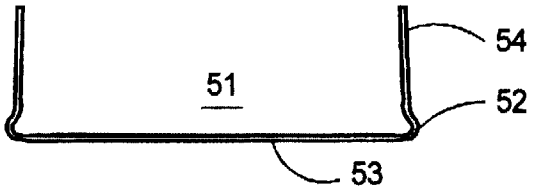
FIG. 18 is a cross-sectional view of a portion of FIG. 17 illustrating the construction technique.
Figure 17:
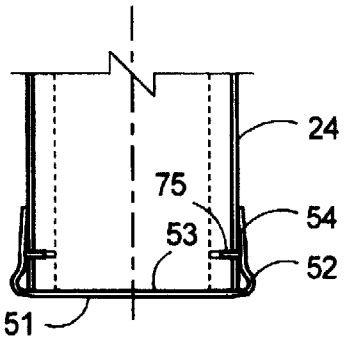
FIG. 17 is a cross-sectional view of a lower track section utilized in conjunction with FIG. 12.

FIGS. 17 and 18 illustrate the same type of profiling which can be applied to the end caps or channels 25 and 26. Here, the profile of a lower track 51 has its width enlarged to avoid interference as in the case of FIGS. 15 and 16 and an increased bending radius 52 to avoid interference.

Referring briefly to FIG. 37, thus this widening allows the hydraulic clamp 74 to firmly place the bottom and top tracks 25, 26 or, as illustrated in FIGS. 17 and 18, track 51 on the ends of the studs 24 so that there is a complete connection or abutment on the entire face of the stud end to the web of the track or channel. This is important in order to carry the heavy loads of multi-story buildings. The flanges 54 are slopped to provide a tight connection with the flanges of the studs 24 and in addition, as illustrated in FIG. 17, fasteners 55 can be used.

FIGS. 19, 21, 23 and 25 are elevation views of various load bearing wall panel assemblies in a descending order of load bearing capabilities (these are without the addition of diagonal bracing or plates); they are generally not shear resistant. All of these load bearing wall assemblies combine the use of light gauge cold rolled steel members with hot rolled steel tubular components of the same depth to form a rigid frame for added load bearing capabilities and to provide a planar surface for well integrated cladding.

Figures 34, 35, 36:
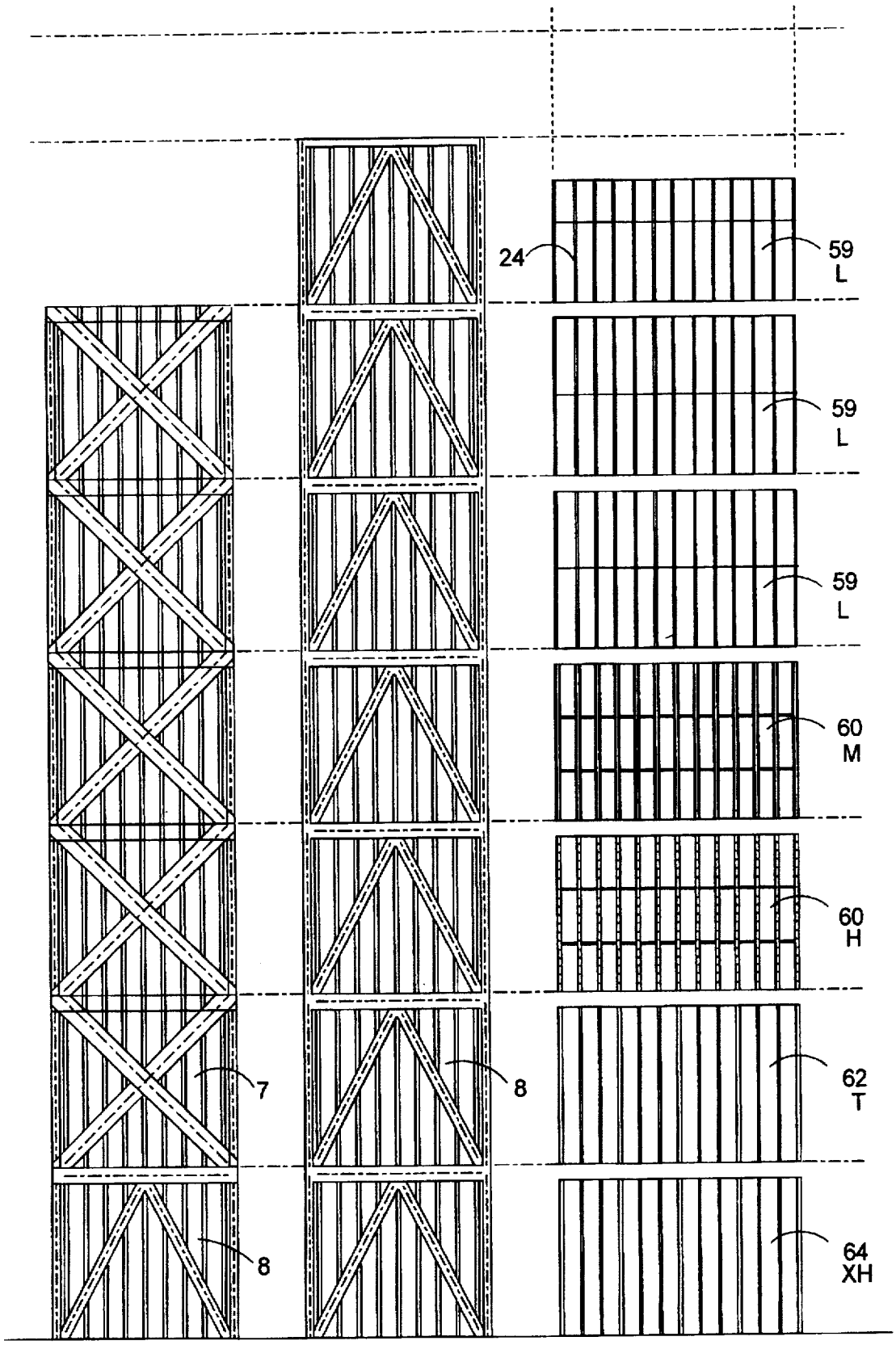
FIG. 34 is an elevation view in cross-section of five stacked stories illustrating the use of the wall panels of FIGS. 12 and 14.
FIG. 35 is an elevation view in cross-section of a seven story building utilizing the wall panels of FIG. 14.
FIG. 36 is an illustration of a multi-story building utilizing various wall panels of FIGS. 19, 21, 23, 25 and 28.

FIG. 36 shows a seven story building formed of stacked wall panels (none of them shear resistant in this case) where the upper three panels 59 are designated "L" for light load bearing, panel 60 is "M" for medium load bearing, panel 61 is "H" for heavy load bearing, panel 62 is "T" for greater load bearing and is a transition panel, and then panel 64 is extra heavy "XH". Now to describe these panels in detail.

Figure 15:
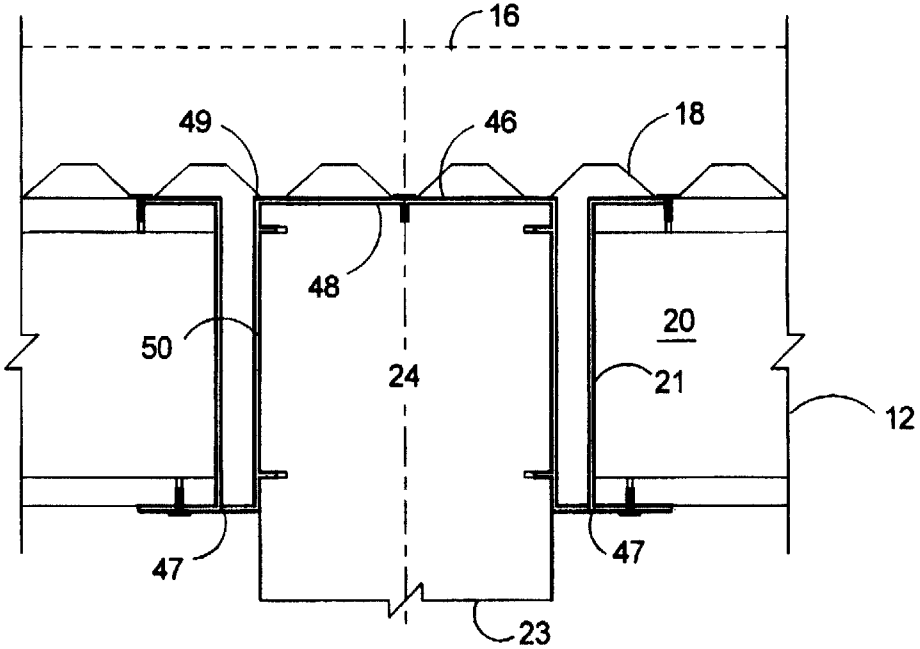
FIG. 15 is a cross-section illustrating a roof joint for the panel of FIG. 12.
Figure 19:
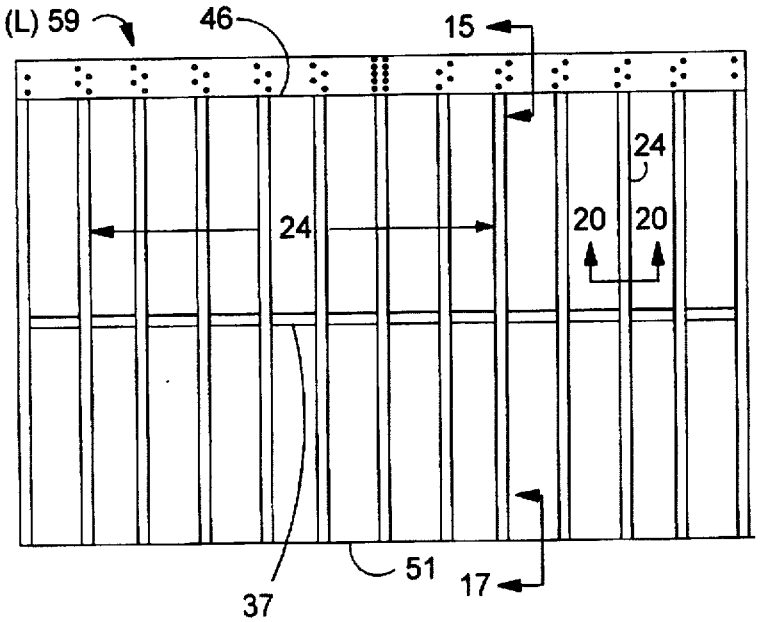
FIG. 19 is an elevation view of a wall panel of an alternative type to FIG. 12.
Figure 20:
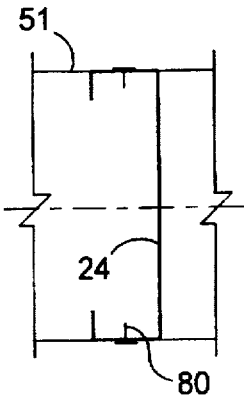
FIG. 20 is a cross-sectional view taken along the line 20—20 of FIG. 19.

FIG. 19 shows panel 59 of the L-type which is formed with the "C" cross-section light gauge steel studs 24, with a uniform spacing of, for example, 12 inches, 16 and 24, etc., attached to a top cap 46, and with a lower track 51. In other words, it is similar to the panel of FIG. 12 but without the diagonal bracing and the hot rolled steel columns 38. Horizontal stud bracing 37 could be added when needed at mid-height. FIG. 20 is a cross-section of one of the studs 24. Screws or fasteners 80 are shown. In addition, cross-sections of upper and lower caps 46 and 51 are shown in FIGS. 15 and 17, respectively. Thus the top cap 46 is suitable as a roof support.

Figure 21:
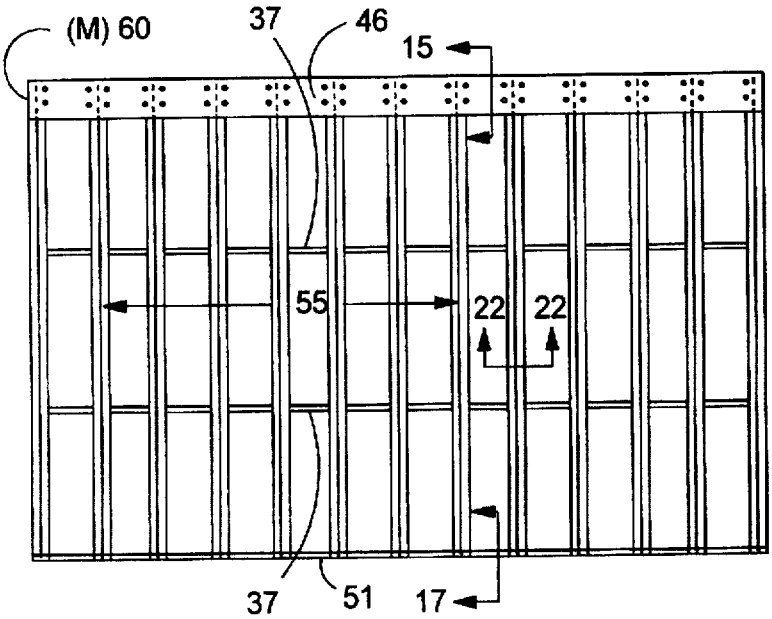
FIG. 21 is an elevation view of an alternative embodiment of another wall panel using light gauge metal similar to FIG. 19.
Figure 22:
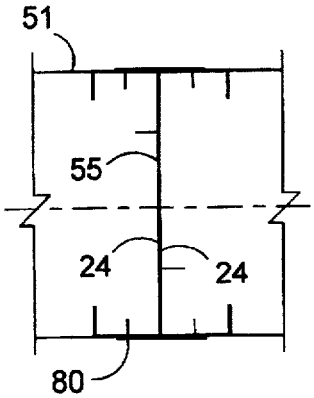
FIG. 22 is a cross-sectional view taken along the line 22—22 of FIG. 21.

FIG. 21 is a type "M" panel 60 with increased load bearing compared to the panel 59 for equal gauge and stud size. Vertical loading bearing members are made of a back-to-back pair of C-shaped studs 24 as illustrated in FIG. 22. Then, intermediate bracings 37 are shown in order to reduce the slenderness ratio and increase the load bearing capacity of each vertical member. Such horizontal intermediate bracings are connected by cold formed clip angles 66 (see FIGS. 31–33). The overall back-to-back type of stud is designated 55.

Figure 23:
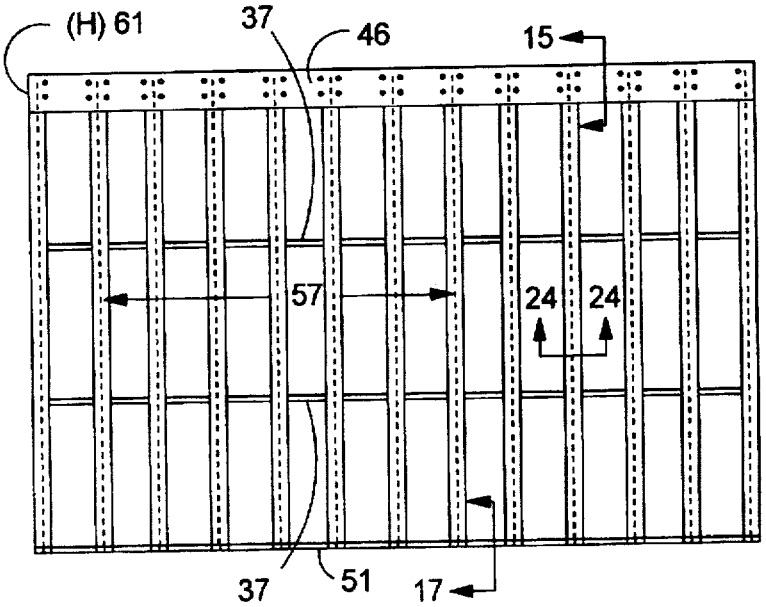
FIG. 23 is an alternative embodiment of yet another wall panel similar to FIG. 19.
Figure 24A:
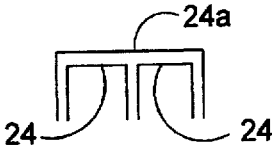
FIG. 24A is an enlarged cross-sectional view of a portion of FIG. 24.
Figure 24:
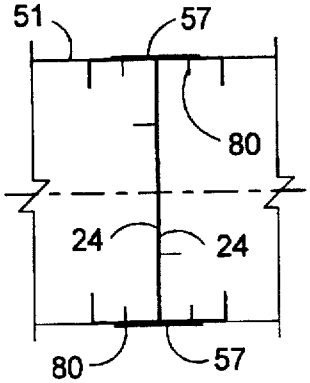
FIG. 24 is a cross-sectional view taken along the line 24—24 of FIG. 23.

FIG. 23 is another variance of a load bearing wall panel 61 designated "H" with greater load bearing capability. This is obtained by the addition of channel shaped reinforcement to the flange side of the back-to-back double studs. FIGS. 24 and 24A show the additional flange **24*a*. The overall stud is designated 57**.

Figure 25:
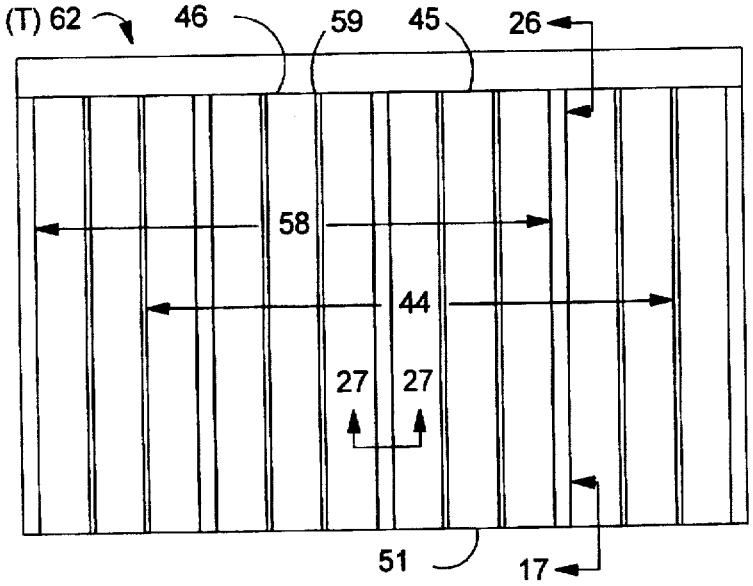
FIG. 25 is an elevation view of yet another alternative embodiment of FIG. 19.
Figure 26:
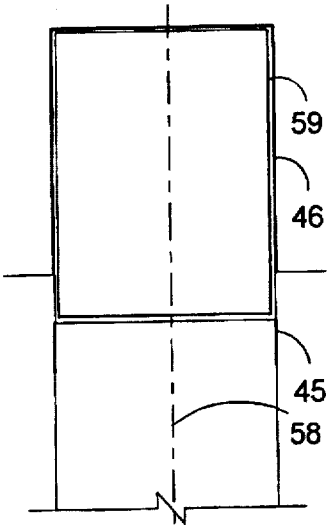
FIG. 26 is a cross-sectional view taken along the line 26—26 of FIG. 25.
Figure 27:
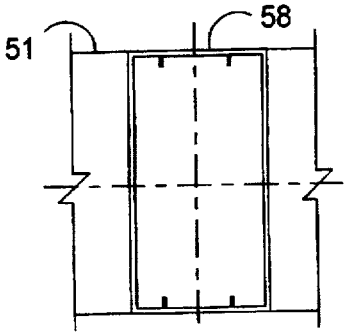
FIG. 27 is a cross-sectional view taken along the line 27—27 of FIG. 25.

FIG. 25 describes a load bearing panel wall 62 of the type "T" used as a transition, as illustrated in FIG. 36, between panel 61 and panel 64. This particular type is formed by a series of hot rolled steel tubular vertical members 58 welded, as illustrated in FIG. 26, to a hot rolled tubular transfer beam 59 for distributing the individual stud loads from the upper wall assembly (that is, 61 of FIG. 36) to the tubular vertical members below. There is a typical bottom track 51 (see FIG. 17) and an inverted U-type cap 46 (see FIG. 26) for wrapping around the top transfer beam. Intermediate non-bearing studs such as the cold rolled studs 44 are added in order to support the wall cladding. Thus, they have the same width as the beams 58. FIG. 27 is a horizontal section through a vertical load bearing member 58.

Figure 29:
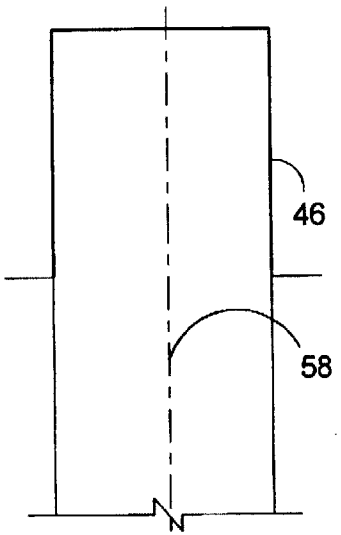
FIG. 29 is an enlarged cross-sectional view taken along the line 29—29 of FIG. 28.
Figure 28:
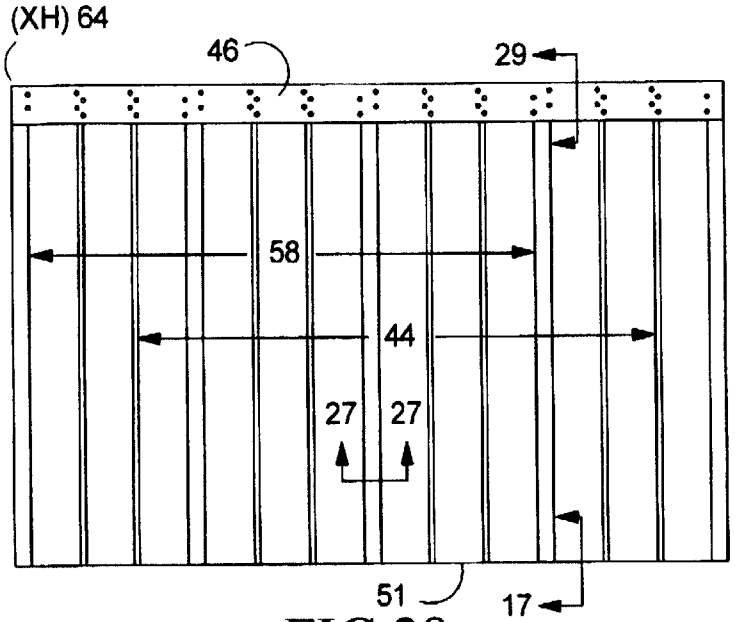
FIG. 28 is another elevation view of another alternative embodiment of FIG. 19.

Finally, FIG. 28 describes the heaviest load bearing wall panel type "XH" 64 which is similar to the panel 62 but does not have a horizontal transfer beam. Here, its load bearing capabilities could be progressively enhanced by increasing the wall thickness and/or the overall depth of the wall frame members. Also, the vertical member spacing could be reduced. FIG. 29 is a vertical section through the top cap.

Thus, the foregoing summarizes the panels of increasing load bearing for use in a multi-story building as illustrated in FIG. 36.

Where shear resistant panels are desired, then the configurations of FIGS. 34 and 35 may be used in combination with that of FIG. 36. FIG. 34 is a multi-story building where the bottom story is the hot rolled inverted V-type wall panel 8 with the upper stories light gauge panels 7. And, then FIG. 35, shows a seven story building constructed entirely of inverted "V" shear/bearing wall panels 8.

Figure 30:
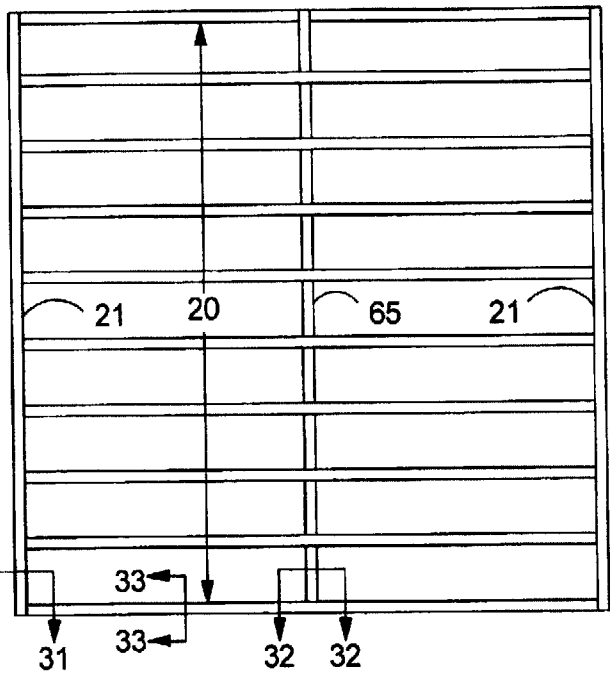
FIG. 30 is a plan view of a floor panel using cold rolled steel members.
Figure 33:
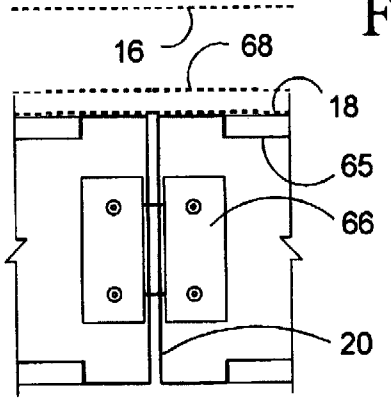
FIG. 33 is a cross-sectional view taken along the line 33—33 of FIG. 30.
Figure 31:
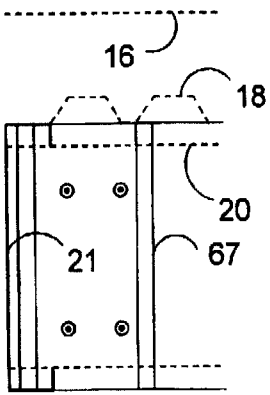
FIG. 31 is a cross-sectional view taken along the line 31—31 of FIG. 30.

FIG. 30 describes a typical floor panel or roof panel 12 using cold roll steel members for all of the framing. This could include C-shaped joist 20 with typical spacings at 12, 16 or 24 inches. Also, channel-shaped tracks 21 are provided at each supporting end. There are one or more intermediate bridging joist sections 65 also made of cold rolled C-sections. These are attached by the clip angles 66 illustrated in FIG. 32. Other clip fastenings are illustrated in FIGS. 31 and 33. The floor or roof and its concrete topped upper surface is symbolically indicated by dashed line 16. Thus, FIG. 31 is a vertical section through the end bearing side of the floor panel indicating web reinforcing using a section of "C" stud attached to the web of a joist 20. FIG. 32 is a vertical section through the floor bridging and FIG. 33 a typical joint between adjoining floor panels showing metal desk bridging 68. With the wall panel construction of the present invention, all cold rolled steel members could be standard or custom perforated at the factory or fabrication plant in order to accommodate the installation of electrical wiring and plumbing lines.

Thus, in summary the present invention provides prefabricated panelized assemblies specifically designed for high-rise construction made mostly of light gauge (cold rolled) steel components. Thus, they are especially suitable for areas of seismic activity or exposure to high winds. Panels can easily be stacked to form continuous trusses able to resist such lateral loads. In locations outside of designated seismic zones, building heights above 160 feet are possible. With the easy and secure connections for stacking wall assemblies, this facilitates field erection and the ability to carry full design loads. The especially profiled cold rolled light steel for upper and lower tracks or channels for the wall panels allow for full bearing of the studs which is a necessity for transmitting high accumulated vertical loads found in high-rise buildings.

Studs may be made of different pieces such as C-shaped or U-profiles in order to resist high vertical loads. The combined use of light gauge cold rolled steel members with the hot rolled tubular steel of the same depth makes panelized wall assemblies easy to fabricate and install. With their flush surfaces, this facilitates the direct installation of fire proofing and finishes such as gypsum board. Use of a special connection between panels such as the spaced erection bolts allows for continuous concrete floor decks to be poured.

In comparison with other high-rise construction techniques, the present invention has the following advantages:

a) weight is reduced and is much lighter being in some installations only 25% of prior or normal building weights;

b) the technique is less expensive offering a 20–25% reduction in overall estimated construction costs;

c) construction time may be reduced by 50% because of the prefabrication and stacking techniques.

Thus, an improved high-rise building system has been provided.

What is claimed is:

1. A lightweight, prefabricated wall panel having left and right ends which is able to resist both vertical and lateral forces for use as a wall in a multi-story building of three or more stories comprising:

a plurality of spaced vertical cold rolled light gauge sheet metal studs extending between top and bottom channels in which they are retained, at least one pair of diagonal tension bracing plates connected to said studs and channels, and a pair of hot rolled steel members affixed vertically to the left and right ends of said panel including said top and bottom channels and said diagonal bracing plates.

2. A prefabricated wall panel as in claim 1 where said multi-story building is an apartment building which includes modular and unitized kitchen and bathroom units having walls said units including as a vertical and lateral force resistant wall at least one of said panels.

3. A wall panel as in claim 1 where said studs have bottoms and tops and wherein said bottom or top channel has an enlarged width to provide a bending radius to fully accommodate and support the bottom or top, respectively, of said studs.

4. A wall panel as in claim 1 wherein the panel has a planar face to facilitate the placement of exterior cladding.

5. A wall panel as in claim 4 where each of said wall panels includes a hot rolled steel angled ledge horizontally aligned to provide support for a lightweight concrete floor after placement of which said cladding may be installed which extends in close proximity down to said floor.

6. A wall panel as in claim 5 wherein said lightweight concrete extends through spaces between said studs.

7. A wall panel as in claim 5 wherein said wall panels which are stacked on adjacent upper and lower floors are spaced between bottom and top channels, respectively, by erection bolts whereby said lightweight concrete floor may extend continuously between upper and lower wall panels.

8. A lightweight wall panel as in claim 1 wherein said panel is constructed by the following steps:

a. providing a table with guides;

b. placing and spacing a plurality of said studs having two ends on said table in said guides with one end of each of said studs against a restrainer;

c. placing either a top or bottom channel on the other ends of said studs; and d. utilizing a power assisted clamp means to push the channel onto the ends of said studs.

9. A lightweight wall panel as in claim 1 where said cold rolled studs and hot rolled members have similar widths to provide a planar surface for installation of cladding.

10. A multi-story building greater than five stories using prefabricated wall panels said building having lower stories and three or more upper stories, the lower stories using stacked wall panels including hot rolled steel tubing to form vertical and lateral force resistant walls which then support on the upper stories wall panels having left and right ends and a plurality of spaced vertical cold rolled light gauge sheet metal studs extending between top and bottom channels in which they are retained, at least one pair of diagonal tension bracing plates connected to said studs and channels, and a pair of hot rolled steel members affixed vertically to the left and right ends of said panel including said top and bottom channels and said diagonal bracing plates.

11. A wall panel as in claim 10 where said wall panels for said lower stories include an inverted "V" formed by said hot rolled steel tubing extending from a top cap to the bottom of the panel.

12. A lightweight prefabricated wall panel which is both load bearing and shear resistant which may be stacked on top of one another for use as a wall in a multi-story building comprising:

each of said panels having a rigid frame consisting essentially of steel structural members which are formed of both cold rolled and hot rolled steel, said members having similar widths to form a substantially planar surface for cladding said frame including means for vertically stacking and interlocking said panels, said cold rolled steel providing light weight and said hot rolled steel providing for enhanced vertical force resistance.

13. A wall panel as in claim 12 where diagonal tension bracing plates are affixed to said frame to provide lateral force resistance.

14. A wall panel as in claim 12 where said means for interlocking and stacking include a pair of plates extending from a hot rolled steel member of a lower panel and weldable to a similar member of an upper panel.

15. A lightweight, prefabricated wall panel having left and right ends which is able to resist both vertical and lateral forces for use as a wall in a multi-story building of three or more stories comprising:

a plurality of spaced vertical cold rolled light gauge sheet metal studs extending between top and bottom steel members to which they are connected, bracing means connected to said studs and top and bottom steel members for providing resistance to lateral forces, and a pair of hot rolled steel members affixed vertically to the left and right ends of said panel including said top and bottom steel members and said bracing means.

* * * * *